United States Patent [19]

Manzer

[11] Patent Number: 4,666,046

[45] Date of Patent: May 19, 1987

[54] SHELL SORTER

[75] Inventor: Jimmie L. Manzer, Modesto, Calif.

[73] Assignee: Sun-Diamond Growers of California, Stockton, Calif.

[21] Appl. No.: 765,761

[22] Filed: Aug. 15, 1985

[51] Int. Cl.[4] ..... B07C 5/34

[52] U.S. Cl. ..... 209/599; 73/865.5; 209/639

[58] Field of Search ..... 209/570, 571, 590, 599, 209/639, 640, 699; 73/12, 79, 573, 658, 865.5

[56] References Cited

U.S. PATENT DOCUMENTS

| | | | |
|---|---|---|---|
| 3,003,628 | 10/1961 | Diamond et al. | 209/599 |
| 3,004,662 | 10/1961 | Armstrong et al. | 209/599 X |
| 3,127,016 | 3/1964 | Baigent | 209/599 X |
| 3,394,806 | 7/1968 | Vaillette | 209/590 |
| 3,543,930 | 12/1970 | Delbridge et al. | 209/590 |
| 3,559,805 | 2/1971 | Cragg | 209/599 X |
| 3,675,660 | 7/1972 | Girodat | 209/599 X |
| 4,091,660 | 5/1978 | Yanagi | 73/658 |
| 4,147,620 | 4/1979 | Artiano et al. | 209/590 |
| 4,212,398 | 7/1980 | Parker et al. | 209/590 |
| 4,466,543 | 8/1984 | Zwahlen et al. | 209/570 X |
| 4,625,872 | 12/1986 | DeLacy et al. | 209/599 X |

*Primary Examiner*—Randolph A. Reese
*Assistant Examiner*—Edward M. Wacyra
*Attorney, Agent, or Firm*—Townsend and Townsend

[57] ABSTRACT

An improved shell sorter is disclosed. One improvement resides in the incorporation of a bandpass filter with a center frequency selected on the basis of the signals produced by a transducer in response to the impact of shell fragments or other components of the material to be rejected against a target plate, instead of a high pass filter which passes signals above a given frequency which possibly represent not only components of the material to be rejected, but other components of the material which may not be desired to be rejected. The use of a bandpass filter provides higher selectivity and precision of operation with respect to the rejection of shell fragments. Another improvement resides in the use of a differential or window comparator circuit for discriminating shell fragments from nut meats which for some reason, such as dryness, cause the transducer to produce a signal having a frequency characteristic which is typically representative of shell fragments. The differential comparator circuit selects a range of amplitudes generally representative of the amplitudes produced by impact of shell fragments against the target plate for the purpose of providing a reject signal and does not produce a reject signal if amplitudes are below a first threshold, such as for small nut meats, or above a second threshold, such as for large nut meats. Other features are also disclosed.

38 Claims, 10 Drawing Figures

SHELL SORTER

BACKGROUND OF THE INVENTION

This invention relates to automated processing of material for rejecting undesired constituents of the material and, more particularly, to segregating shell fragments from nut meats for rejecting the shell fragments during the automated processing of food nuts. Specifically, the invention is directed to bandpass filtering the signal produced by a transducer connected to a target plate against which particles, such as nut meats and shell fragments, are impacted for improved discrimination between shell fragments and nut meats, as well as solving the mass weight problem so that signals within the frequency pass and which are typically associated with shell fragments nut which exceed a predetermined amplitude are considered to be produced by nut meats such that these nut meats are not rejected.

There are various situations in which one component of bulk material is desirably separated from another component or components of the material. One situation where such a need arises is in the field of processing foodstuffs, particularly when large quantities of edible product are harvested or otherwise being processed. For example, Armstrong et al., U.S. Pat. No. 3,004,662, and Baigent, U.S. Pat. No. 3,127,016, disclose sorting foreign substances from foodstuffs; Cragg, U.S. Pat. No. 3,559,805, discloses removing stones and rocks from harvested potatoes; and Girodat, U.S. Pat. No. 3,675,660, discloses rejecting relatively hard objects, such as rocks, large enough to damage the elevator, cylinder, or concave of a combine harvester during the harvesting of crop material.

Generally, these patents are directed to culling inorganic material from foodstuffs at an early stage during the processing of the foodstuff. The inorganic material and the foodstuff have substantially different characteristics of mass and density, which can facilitate the discrimination between the unwanted material and the foodstuff.

Each of the referenced patents discloses a structure which comes into contact with a material to be processed. The structure is connected to a transducer. One component of the material causes the transducer to produce a signal having a first characteristic, and another component of the material causes the transducer to produce a signal having a second characteristic. Generally, a high pass filter is used to discriminate one component of the material from the other, and the amplitude produced by the passed signal is detected by a threshold detector which controls the operation of a reject device.

The discrimination between unwanted and desired components of bulk material is also present at later stages of processing foodstuffs. The problems which attend separation of unwanted and wanted components of the material at these later processing stages is exacerbated by several factors. One factor is that the characteristics of the unwanted material and the characteristics of the wanted material lessen, which renders discrimination between the undesired and desired components difficult. For example, the segregation can be between two components of organic material, rather than between an inorganic component and an organic component. Furthermore, the processing of the foodstuff can contribute to reducing the differences between the physical characteristics of the undesired and desired components of the material, for example, differences in the mass and density of the components of the material are reduced.

One situation where problems have arisen is during the processing of food nuts where shells and shell fragments are desirably culled from shelled nuts before the nut meats are packaged. The reasons for culling shells and shell fragments from nut meats are to avoid the risk of injury to a consumer who might otherwise inadvertently chew or swallow a shell and also to avoid customer dissatisfaction by minimizing the amount of unedible shells in packages of shelled nuts for which the consumer has paid.

Various techniques for culling shell fragments from nut meats are known. Originally, separation was performed by hand.

Rising labor costs and advances in technology have subsequently led to automated techniques for rejecting shell fragments from nut meats. One known technique used for sorting shell fragments from nut meats uses ultraviolet light for color sorting. The ultraviolet absorption characteristics of shell fragments differ from the ultraviolet absorption characteristics of nut meats. One such color sorter is the Model 5141E Color Sorter manufactured by Scan-Core, Inc. located in Mountain View, Calif.

Another automated technique for discriminating between shell fragments and nut meats is disclosed in Parker et al., U.S. Pat. No. 4,212,398. Parker et al., U.S. Pat. No. 4,212,398, discloses a technique which is based on differentiation of the characteristic frequencies of the signal produced by a transducer connected to a sounding plate upon impact of shell fragments, on the one hand, and nut meats, on the other.

Shell fragments generally cause the transducer to produce a signal having one frequency characteristic, whereas nut meats cause the transducer to produce a signal having a different frequency characteristic. Unfortunately, the circuit disclosed in Parker et al., U.S. Pat. No. 4,212,398, includes a high pass filter which has a frequency response characteristic that does not provide sufficient selectivity. The use of a high pass filter is adequate to separate stones from nuts during early stages of processing, but does not possess sufficient selectivity to adequately separate shells and shell fragments from nut meats during later processing stages after shelling.

Furthermore, Parker et al., U.S. Pat. No. 4,212,398, does not address the mass weight problem. Specifically, although the general circumstance is that shell fragments produce a signal having a different frequency from the frequency of the signal produced by nut meats, nevertheless, some nut meats, because they are dry, for example, cause the transducer connected to the sounding plate to produce a signal having a frequency characteristic similar to the frequency characteristic produced by a shell fragment upon impact with the sounding plate. The circuit disclosed in Parker et al., U.S. Pat. No. 4,212,398, is not able to discriminate between such nut meats and shell fragments. After amplifying the input signal and filtering low frequency signals from it, a comparator included in the circuit disclosed in Parker et al., U.S. Pat. No. 4,212,398, converts those original oscillations which exceed a predetermined threshold amplitude into voltage pulses that are counted in a counter. If the count exceeds a minimum set into the counter, the counter produces a signal. This signal initiates an output signal of predetermined duration, which after undergoing a delay, operates an air valve that is connected with an air nozzle located along a rebound trajectory, so that an air blast deflects the particle into a reject trajectory. Furthermore, oscillations in the input signal that exceed another and higher threshold amplitude can be converted into pulses which themselves initiate the output signal without being counted. In this instance the signal that is produced overrides the output signal derived from the counter and is of longer duration, which produces a longer air blast, so that heavy particles are deflected. Unfortunately, many of these heavy particles prove to be large nut meats. Consequently, nut meats are rejected along with shell fragments with attendant economic loss.

SUMMARY OF THE INVENTION

The invention provides improved discrimination based on the respective frequency characteristics typically associated with shell fragments and nut meats, which appear in the signal produced by a transducer means connected to a target means. One aspect of the invention is directed to the use of a bandpass filter for discriminating shell fragments, which generally have one characteristic frequency, and nut meats, which generally have a different characteristic frequency. Another aspect of the invention is directed to a solution to the mass weight problem, that is, notwithstanding the fact that shell fragments and nut meats generally produce different frequencies, there is occasionally a case where a nut meat appears to be a shell fragment. In such a case, however, the nut meat has a relatively greater weight, and therefore the transducer means produces a relatively large amplitude signal upon impact with the target means, which can be differentiated from a signal produced by a shell fragment upon impact with the target means by the use of a differential or window comparator circuit.

In accordance with one embodiment of the invention, an improved sorting apparatus is provided. The sorting apparatus comprises, in combination: target means against which first particles, such as shell fragments, and second particles, such as nut meats, are impinged; transducer means for converting vibrations induced in the target means into an electrical signal having a frequency and amplitude representative of the vibrations caused by impact of the first particles and second particles against the target means; and a bandpass filter for filtering the signal produced by the transducer means for discriminating signals generally representative of first particles from those signals generally representative of second particles. The bandpass filter can be tuned to a predetermined harmonic frequency correlated to the fundamental frequency of signals generally representative of first particles for discriminating signals generally representative of first particles from those signals generally representative of second particles for providing higher selectivity. The sorting apparatus preferably further comprises a differential comparator circuit for discriminating signals within the pass band generally representative of first particles, such as shell fragments, for producing a reject signal.

The circuit in accordance with the invention is an improvement over the circuit disclosed in Parker et al., U.S. Pat. No. 4,212,398, in two important respects. The first respect is that a bandpass, rather than a high pass, filter is included for filtering the signal produced by the transducer means connected to the target means in response to the impact of shell fragments and nut meats against the target means. The basis for this improvement is that shell fragments generally cause the transducer means to produce a signal having one predetermined frequency characteristic, whereas nut meats cause the transducer means to produce a signal having a different frequency characteristic. Consequently, the bandpass filter can be selected so that the center frequency is set at the frequency generally associated with the signal produced by the transducer means in response to the impact of shell fragments against the target means. Since the signal frequencies produced by shell fragments are different from the signal frequencies produced by nut meats, shell fragments can be discriminated on the basis of their frequency characteristic as determined by the frequency response characteristic of the bandpass filter. The bandpass filter in accordance with the invention provides higher selectivity in the discrimination of shell fragments from nut meats than the high pass filter disclosed in Parker et al., U.S. Pat. No. 4,212,398, and therefore more effectively discriminates between shell fragments and nut meats during later stages of the processing of food nuts.

The second respect is based on a solution of the mass weight problem which is not addressed in Parker et al., U.S. Pat. No. 4,212,398. Specifically, although the general situation is that shell fragments produce a signal having a different frequency from the frequency of the signal produced by nut meats, nevertheless, some nut meats, because they are dry, for example, cause the transducer means connected to the target means to produce a signal having a frequency characteristic similar to the frequency characteristic produced by a shell fragment upon impact with the target means. The circuit in accordance with the invention, however, discriminates between such nut meats and shell fragments. The basis for this improvement is that the signals produced by nut meats which for some reason have a frequency characteristic similar to that of shell fragments are relatively large compared to the signals produced by shell fragments. Consequently, a differential or window comparator circuit is included which discriminates high amplitude signals within the pass band representative of nut meats from lower amplitude signals within the pass band associated with shell fragments so that nut meats are not rejected.

BRIEF DESCRIPTION OF THE DRAWINGS

The above and other features of the invention and the concomitant advantages will be better understood and appreciated by those skilled in the art in view of the description of the preferred embodiments given below in conjunction with the accompanying drawings. In the drawings:

FIG. 4, comprising

DESCRIPTION OF THE PREFERRED EMBODIMENTS

Figure 1:
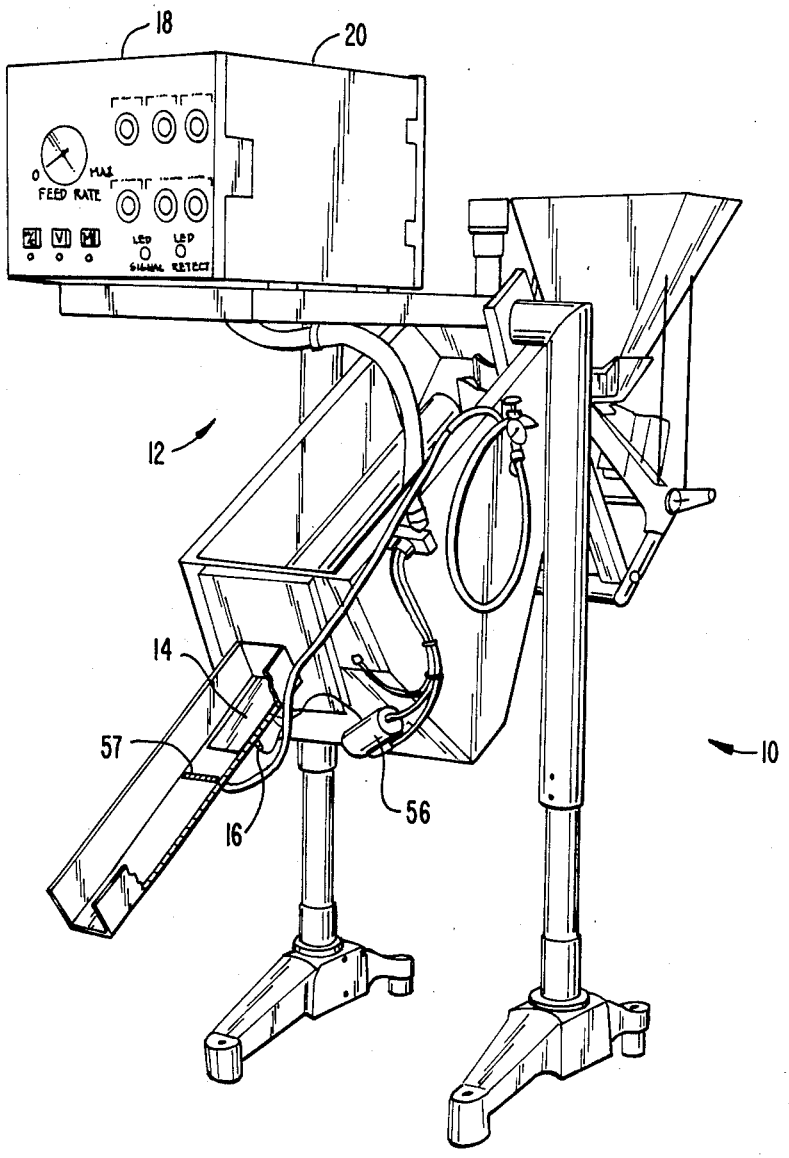
FIG. 1 is an isometric view of shell sorting apparatus in accordance with the invention.

The shell sorting apparatus in accordance with the invention, generally indicated by the numeral 10 shown in FIG. 1, includes product feeding means 12. The product feeding means 12 can take any one of a number of different forms. Preferably, the shell sorting apparatus 10 incorporates a Scan-Core feed system included in the Model 5141E Color Sorter, which is a counter roller type feed system, as the product feeding means 12. A slide chute could, however, be used.

The shell sorting apparatus 10 also includes target means 14 and transducer means 16. The target means 14 and transducer means 16 are preferably substituted for the optical scanner included in the Scan-Core color sorter.

The shell sorting apparatus 10 further includes a housing 18. A circuit or circuit means 20 shown in FIG. 2 is also included in the shell sorting apparatus 10 preferably contained in the housing 18.

Figure 2:
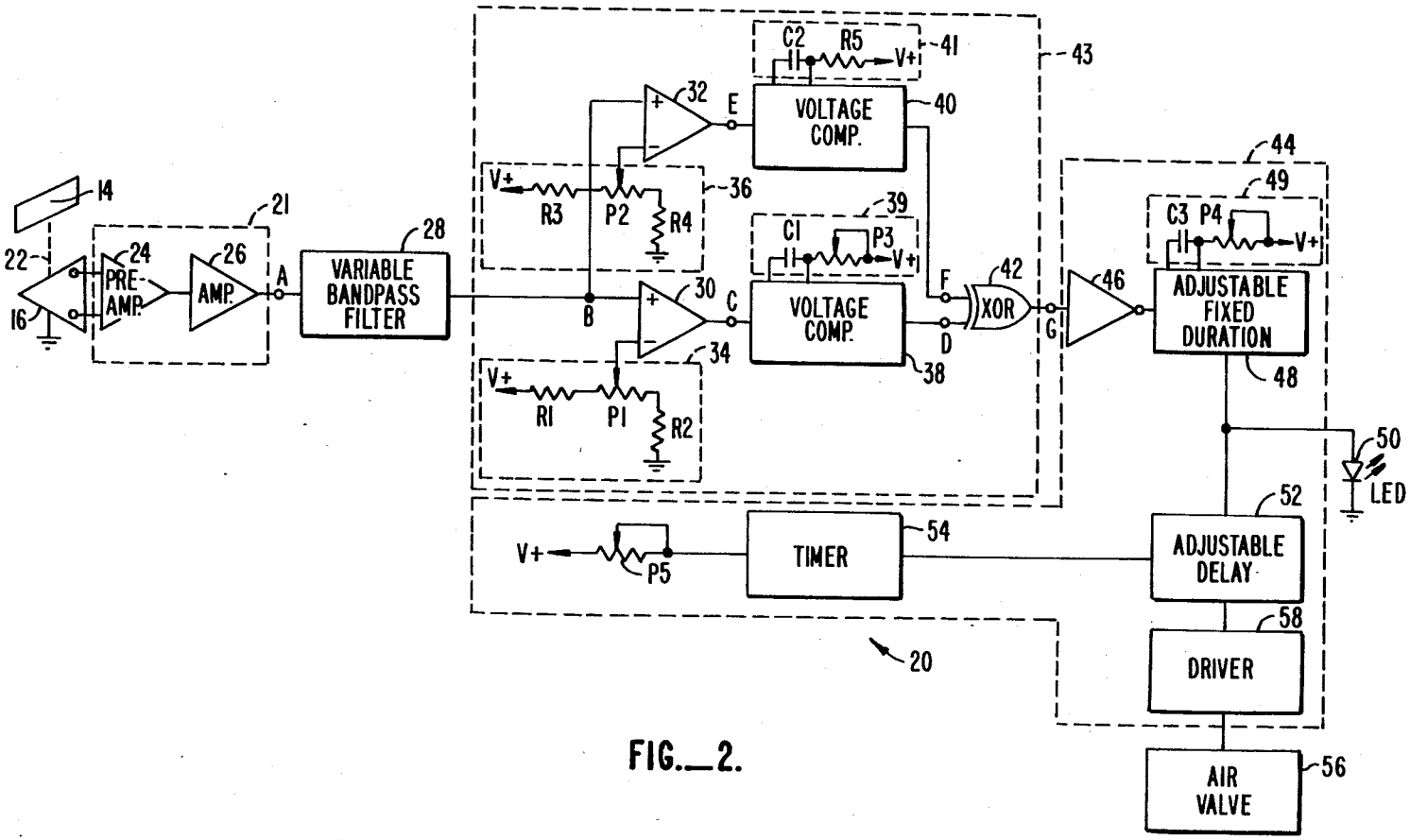
FIG. 2 is a schematic circuit diagram of one embodiment of a circuit in accordance with the invention included in the shell sorting apparatus shown in FIG. 1.

In accordance with the invention, a bandpass filter 28 is included in the circuit 20, as shown in FIG. 2, for discriminating signals generally representative of shell fragments. A solution of the mass weight problem is also provided in accordance with the invention based on inclusion of a differential or window comparator circuit 43 in the circuit 20, as shown in FIG. 2.

As shown in FIG. 2, the circuit 20 generally includes the transducer means 16, a signal conditioning circuit 21, the bandpass filter 28, the differential or window comparator circuit 43, and a reject control circuit 44. The shell sorting apparatus 10 further includes a solenoid controlled air valve 56. The circuit 20 is responsive to the signal produced by the transducer means 16 and detects impact of a shell fragment against the target means 14 for energizing the solenoid controlled air valve 56 for causing the air valve to issue a blast of air in order to reject the shell fragment.

With reference to FIGS. 1 and 2, the shell sorting apparatus 10 generally operates as follows. The product feeding means 12 transports material, namely, shell fragments and nut meats, such that the material falls by gravity onto the target means 14. The product feeding means 12 transports the shell fragments and nut meats so that only one particle strikes the target means 14 at a time. The impact of shell fragments against the target means 14 causes the transducer means 16 to produce a signal generally having a first frequency characteristic, and nut meats impacted against the target means cause the transducer means to produce a signal having a different frequency characteristic. The signal produced by the transducer means 16 in response to impact of shell fragments and nut meats against the target means 14 is processed by the circuit 20 contained in the housing 18.

Generally, the impact of a shell fragment or a nut meat on the target means 14 causes the target means to vibrate. Meanwhile, the shell fragment or nut meat ricochets from the target means 14 toward the outlet 57 of the solenoid controlled air valve 56. The operation of the circuit 20 is such that detection of a shell fragment occurs in a time less than or equal to the time interval during which the shell fragment travels between the target means 14 and the outlet 57 of the solenoid controlled air valve 56.

The transducer means 16 is connected to the target means 14 and is responsive to the mechanical vibrations imparted to the target means for producing an alternating current electrical signal correlated in frequency and amplitude to the mechanical vibrations. The transduced signal is processed by the signal conditioning circuit 21 for providing a conditioned signal having a level appropriate for the remainder of the circuit 20.

The conditioned signal is then bandpass filtered by the bandpass filter 28 whose center frequency is preferably set to a characteristic frequency of the transduced signal typically produced when a shell fragment impacts the target means 14. The bandpass filter 28 provides high selectivity for discriminating signals produced by the transducer means 16 having the frequency characteristic of a shell fragment.

The signal produced by the transducer means 16 must include a frequency component that typically appears when a shell fragment strikes the target means 14 in order for the bandpass filter 28 to produce a signal. Otherwise, no signal is fed to the differential or window comparator circuit 43.

On the one hand, if such a frequency component is not present in the signal produced by the transducer means 16, the bandpass filter 28 feeds no signal to the differential comparator circuit 43. In this case, the particle is considered to be a nut meat. Consequently, the differential comparator circuit 43 disables the reject control circuit 44. As a result, the solenoid controlled air valve 56 is not energized to issue an air blast to blast the particle from the path of travel after the particle ricochets from the target means 14.

On the other hand, if the signal produced by the transducer means 16 includes a frequency component that typically appears when a shell fragment strikes the target means 14, the bandpass filter 28 produces a signal which is fed to the differential comparator circuit 43. The differential comparator circuit 43 must then detect whether or not the amplitude of the bandpass filtered signal has an amplitude typically produced when a shell fragment strikes the target means 14.

One requirement for detection of a shell fragment is that the amplitude of the signal fed by the bandpass filter 28 to the differential comparator circuit 43 have an amplitude which equals or exceeds the lower threshold of the window established by the differential comparator circuit. This is to preclude rejection in the case where the signal fed by the bandpass filter 28 to the differential comparator circuit 43 has a level which is on the order of the amplitude of noise, as well as in the case where the bandpass filtered signal has an amplitude so low as to be atypical of the amplitude of the bandpass filtered signal when a shell fragment strikes the target means 14. This, for example, can be the case when a nut meat impacts against the target means 14.

Furthermore, another requirement for detection of a shell fragment is that the amplitude of the signal fed by the bandpass filter 28 to the differential comparator circuit 43 have an amplitude which is less than the upper threshold of the window established by the differential comparator circuit. This is to avoid rejection in the case of large particles which are typically nut meats rather than shell fragments but which for some reason, such as dryness or for some other reason, have a frequency component which typically appears in the bandpass filtered signal when a shell fragment strikes the target means 14. This solves the mass weight problem in that the circuit 20 does not reject large nut meats.

Thus, the differential comparator circuit 43 provides a signal window through which the signal fed by the bandpass filter 28 must pass. Specifically, the bandpass filtered signal must be at or above the lower threshold, so as to be higher than the amplitude of the noise level and signals produced by small nut meats, and also must be below the upper threshold, so as to be lower than the amplitude of signals produced by large nut meats. The signal fed by the bandpass filter 28 to the differential comparator circuit 43 must pass through this window in order for the particle to be considered a shell fragment.

The differential comparator circuit 43 typically disables the reject control circuit 44 so that the solenoid controlled air valve 56 is de-energized. However, when a signal is fed by the bandpass filter 28 to the differential comparator circuit 43 and is within the window established for the differential comparator circuit, the reject control circuit 44 is enabled so that the solenoid controlled air valve 56 is energized. The reject control circuit 44 is configured so that the solenoid controlled air valve 56 is energized at the appropriate time such that a particle detected to be a shell fragment ricochets to a position proximate the outlet 57 of the air valve, whereby the air which issues from the outlet blasts the shell fragment from the typical ricochet path onto some other path for rejecting the shell fragment.

Considered in more detail, the circuit 20 in accordance with the invention includes the transducer means 16 mechanically connected by a mechanical link 22, such as an adhesive bond, to the target means 14 against which shell fragments and nut meats are impacted, as shown in FIG. 2. The transducer means 16 can be a barium-titanite crystal acoustic transducer. The transducer means 16 is preferably a Model No. AC175D barium-titanite crystal acoustic transducer (length=2.0 inches, outside diameter=13/16 inch) manufactured by Acoustic Emission Technology Corporation of Sacramento, Calif. The target means 14 is configured so that the natural frequency of the target means matches the natural frequency of the transducer means 16. Consequently, the signal produced by the transducer means 16 has the optimum response. The frequency response of the target means 14 is determined by the size and material from which the target means is constructed. Preferably, the target means 14 is in the form of a metal plate comprised of nonmagnetic metal. In the case where the transducer means 16 is an Acoustic Emission Technology Model No. AC175D transducer, the target means 14 is preferably a 10-gauge stainless steel plate having a length of 2.75 inches and a width of 1.0 inch.

The adhesive which bonds the target means 14 to the transducer means 16 provides a continuous, even bond entirely across the surface of the transducer means and also provides efficient transmission of acoustic signals from the target means to the transducer means. Preferably, the adhesive is hot stick glue available from Sears, Roebuck and Company department stores typically used for gluing metal together.

In the case where the target means 14 is a 2.75×1.0 inch 10-gauge stainless steel plate bonded by Sears hot stick glue to the transducer means 16 in the form of an Acoustic Emission Technology Model No. AC175D transducer, the signal produced by the transducer means is 1 VRMS under typical operating conditions wherein average size particles impact against the target means. Also, as will be described in more detail later, the fundamental frequency of the signal produced by the transducer means 16 in this specific implementation upon impact of shell fragments against the target means 14 is approximately 55K hertz.

The output of the transducer means 16 is connected to the input of a preamplifier 24 included in the signal conditioning circuit 21. The preamplifier 24 amplifies the signal produced by the transducer means 16.

The output of the preamplifier 24 is connected to the input of a variable amplifier 26 also included in the signal conditioning circuit 21. The amplifier 26 amplifies the preamplified transduced signal to a signal level appropriate for the remainder of the circuit 20. The signal produced by the amplifier 26 appears at a node designated as node A in FIG. 2.

The output of the amplifier 26 is connected to the input of the bandpass filter 28. The bandpass filter 28 is preferably a variable bandpass filter. The bandpass filter 28 is adjusted to pass only a preselected portion of the signal produced by the transducer means 16. The signal produced by the bandpass filter 28 appears at a node designated as node B in FIG. 2.

Figure 3:
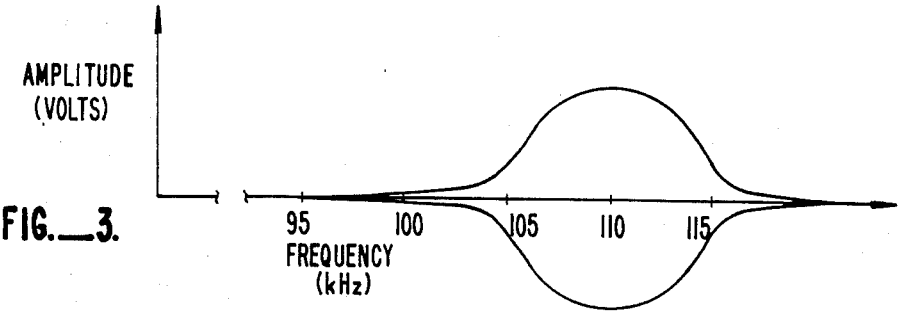
FIG. 3 is an illustration of the frequency response characteristic of the bandpass filter included in the circuit shown in FIG. 2.

The frequency response characteristic of the bandpass filter 28 is shown in FIG. 3. Generally, the frequency of the signal produced by impact of nut meats against the target means 14 is below the pass band, whereas impact of shell fragments against the target means produces a signal frequency which can be used as the center frequency of the bandpass filter 28. In the case where the target means 14 is a 2.75×1.0 inch 10-gauge stainless steel plate bonded by Sears hot stick glue to the transducer means 16 in the form of an Acoustic Emission Technology Model No. AC175D transducer, the fundamental frequency of the signal produced by the transducer means in response to the impact of shell fragments against the target means has been found to be approximately 55K hertz. However, the center frequency of the bandpass filter 28 can be a harmonic of the fundamental frequency, such as the second harmonic, i.e., 110K hertz, for higher selectivity. Consequently, as shown in FIG. 3, the center frequency of the bandpass filter 28 is preferably 110K hertz, and the pass band is approximately 107.5K hertz to 112.5K hertz or as desired.

The output of the bandpass filter 28 is connected to both the non-inverting input of a first peak detector (low) 30 and the non-inverting input of a second peak detector (high) 32 included in the differential or window comparator circuit 43, as shown in FIG. 2. The threshold level for the peak detector (low) 30 is set by means of a voltage divider 34. The voltage divider 34 includes a resistor R1, a potentiometer P1, and a resistor R2 connected in series between a source of voltage V+ and common, the wiper of the potentiometer P1 being connected to the inverting input of the peak detector (low) 30. The potentiometer P1 is adjusted to provide a threshold for the peak detector (low) 30. Preferably, the threshold for the peak detector (low) 30 is in the range of 25 mV to 1.2 V.

The function of the peak detector (low) 30 is to discriminate signals produced by the transducer means 16 contemporaneously with the time of impact of shell fragments, for example, against the target means 14 from vibrations of the target means which continue long after impact or are low amplitude vibrations introduced by other phenomena, such as vibrations coupled from the product feeding means 12 (FIG. 1) to the target means through the mechanical structure. The signal produced by the peak detector (low) 30 appears at a node designated as node C in FIG. 2.

The threshold for the peak detector (high) 32 is set by means of a voltage divider 36. The voltage divider 36 includes a resistor R3, a potentiometer P2, and a resistor R4 connected in series between the source of voltage V+ and common, the wiper of the potentiometer P2 being connected to the inverting input of the peak detector (high) 32. The potentiometer P2 is adjusted to provide a threshold for the peak detector (high) 32. Preferably, the threshold for the peak detector (high) 32 is in the range of 1 to 15 V.

The function of the peak detector (high) 32 is to detect nut meats, which for some reason cause the transducer means 16 to produce a signal having a frequency within the range typically associated with shell fragments, from particles which are in fact shell fragments. Detection is based on the fact that nut meats which for some reason have such a frequency characteristic are generally larger and therefore cause the transducer means 16 to produce relatively high amplitude signals vis-a-vis the signals produced by shell fragments. The signal produced by the peak detector (high) 32 appears at a node designated as node E in FIG. 2.

The output of the peak detector (low) 30 is connected to the input of a first voltage comparator 38 also included in the differential comparator circuit 43. The first voltage comparator 38 is preferably in the form of a one-shot which produces a signal having a predetermined voltage level and duration in response to each signal produced by the peak detector (low) 30. That is, the first voltage comparator 38 produces a predetermined-amplitude, fixed-duration signal each time the peak detector (low) 30 detects that the signal produced by the bandpass filter 28 exceeds the threshold for the peak detector (low), which generally occurs when a particle having the frequency characteristic of a shell fragment impacts against the target means 14. The duration of the signal produced by the first voltage comparator 38 is determined by an RC circuit 39 including a capacitor C1 and a potentiometer P3 connected to the first voltage comparator and the source of voltage V+. The pulsewidth of the signal produced by the first voltage comparator 38 is preferably adjustable from 2.2 milliseconds to 24.2 milliseconds by adjusting the potentiometer P3 included in the RC circuit 39. The pulsewidth of the signal produced by the first voltage comparator 38 is preferably adjusted to match the pulsewidth of the signal produced by a second voltage comparator 40, the pulsewidth of the signal produced by the second voltage comparator being 10.3 milliseconds as will be described in more detail later. The signal produced by the first voltage comparator 38 appears at a node designated as node D in FIG. 2.

The output of the peak detector (high) 32 is connected to the input of the second voltage comparator 40 also included in the differential comparator circuit 43. The second voltage comparator 40 is preferably in the form of a one-shot which produces a signal having a predetermined voltage level and duration in response to each signal produced by the peak detector (high) 32. That is, the second voltage comparator 40 produces a predetermined-amplitude, fixed-duration signal when the signal from the bandpass filter 28 equals or exceeds the threshold for the peak detector (high) 32, which occurs when particles having a large amplitude associated with nut meats which for some reason have a frequency characteristic of shell fragments impact against the target means 14. The duration of the signal produced by the second voltage comparator 40 is determined by an RC circuit 41 including a capacitor C2 and a resistor R5 connected to the second voltage comparator and the source of voltage V+. The pulsewidth of the signal produced by the second voltage comparator 40 is preferably 10.3 milliseconds. The signal produced by the second voltage comparator 40 appears at a node designated as node F in FIG. 2.

The output of the first voltage comparator 38 is connected to one input of an EXCLUSIVE-OR gate 42 also included in the differential comparator circuit 43. The output of the second voltage comparator 40 is connected to a second input of the EXCLUSIVE-OR gate 42. The signal produced by the EXCLUSIVE-OR gate 42 appears at a node designated as node G in FIG. 2.

The characteristic of the EXCLUSIVE-OR gate 42 is as follows. On the one hand, the output of the EXCLUSIVE-OR gate 42 is at a first predetermined level, or low logic state, when the signals produced by the first voltage comparator 38 and second voltage comparator 40 are the same. On the other hand, the EXCLUSIVE-OR gate 42 produces a signal having a second predetermined level, or high logic state, when the signals produced by the first voltage comparator 38 and second voltage comparator 40 differ.

The peak detector (low) 30 adjusted by means of the voltage divider 34 together with the first voltage comparator 38, the period of whose signal is adjusted by means of the RC circuit 39, on the one hand, plus the peak detector (high) 32 adjusted by means of the voltage divider 36 together with the second voltage comparator 40, the period of whose signal is determined by means of the RC circuit 41, on the other hand, plus the EXCLUSIVE-OR gate 42 comprise the differential comparator circuit 43. The differential comparator circuit 43 operates to solve the mass weight problem by detecting which signals within the pass band of the bandpass filter 28 are nut meats because of mass, as opposed to shell fragments.

The signal produced by the first voltage comparator 38 will be at a low logic state, and the signal produced by the second voltage comparator 40 will also be at a low logic state, when a small nut meat or vibrations produced by other causes are present. Also, the signal produced by the first voltage comparator 38 will be at a high logic state, and the signal produced by the second voltage comparator 40 will be at a high logic state, when a large nut meat impacts against the target means 14. In either of these cases, the EXCLUSIVE-OR gate 42 in response produces a signal having a low logic state which disables the reject control circuit 44, as will be described shortly. Conversely, when a shell fragment impacts against the target means 14, the first voltage comparator 38 produces a signal having a high logic state, and the second voltage comparator 40 produces a signal having a low logic state. Consequently, the EXCLUSIVE-OR gate 42 produces a signal having a high logic state, which enables the reject control circuit 44 so that the shell fragment is rejected.

The output of the EXCLUSIVE-OR gate 42 is connected to the input of an inverter 46 included in the reject control circuit 44. The inverter 46 simply inverts the signal produced by the EXCLUSIVE-OR gate 42.

The output of the inverter 46 is connected to the input of an adjustable fixed-duration circuit 48 also included in the reject control circuit 44. The duration of the signal produced by the adjustable fixed-duration circuit 48 is determined by an RC circuit 49 including a capacitor C3 and a potentiometer P4 connected to the adjustable fixed-duration circuit and the source of voltage V+. The adjustable fixed-duration circuit 48 is preferably in the form of a one-shot which produces a predetermined-amplitude, fixed-duration signal in response to being triggered by a negative-going signal produced by the inverter 46, which occurs in circumstances when a shell fragment impacts against the target means 14. The pulsewidth of the signal produced by the adjustable fixed-duration circuit 48 is preferably adjustable from 1.8 milliseconds to 34.8 milliseconds by adjusting the potentiometer P4 included in the RC circuit 49. The potentiometer P4 can preferably be adjusted by an operator by means of a control means on the housing 18. The pulsewidth is adjusted to provide a blast of air from the outlet 57 of the solenoid controlled air valve 56 which has a sufficient period to reject particles. When the potentiometer P4 is set, the signal produced by the adjustable fixed-duration circuit 48 has a fixed pulsewidth.

The output of the adjustable fixed-duration circuit 48 is connected to a light emitting diode (LED) 50 on the housing 18 (FIG. 1), which is illuminated when a shell fragment is detected. The output of the adjustable fixed-duration circuit 48 is also connected to the input of an adjustable delay circuit 52 also included in the reject control circuit 44, as shown in FIG. 2. Another input of the delay circuit 52 is connected to the output of a timer circuit 54 also included in the reject control circuit 44. The timer circuit 54 generates timing pulses. The frequency of the timing pulses generated by the timer circuit 54 is controlled by a potentiometer P5 connected between the source of voltage V+and the timer circuit. The delay circuit 52 is preferably in the form of a shift register which shifts the signal produced by the adjustable fixed-duration circuit 48 from the input of the delay circuit to the output of the delay circuit in response to timing pulses generated by the timer circuit 54. The delay interposed by the delay circuit 52 is adjustable by adjusting the potentiometer P5 which controls the frequency of the timing pulses generated by the timer circuit 54. The delay circuit 52 functions to set a time delay between impact of a shell fragment against the target means 14 and the time required for the shell fragment to travel between the target means and the outlet 57 of the solenoid controlled air valve 56. The delay interposed by the delay circuit 52 assures an air blast from the outlet 57 of the solenoid controlled air valve 56 at the appropriate time to reject the shell fragment.

The output of the delay circuit 52 is connected to the input of a driver circuit 58 also included in the reject control circuit 44. The inverter 46, adjustable fixed-duration circuit 48 and associated RC circuit 49, delay circuit 52, timer circuit 54 and associated potentiometer P5, and driver circuit 58 comprise the reject control circuit 44. In response to a signal from the delay circuit 52, the driver circuit 58 functions to energize the solenoid controlled air valve 56 which issues a blast of air from the outlet 57 to blast the shell fragment from the stream of particles which ricochets from the target means 14. The solenoid controlled air valve 56, for example, can be a reject air valve assembly included in the Scan-Core color sorter (reference Scan-Core Drawing C8887D).

TABLE I lists circuit types and parametric values for an illustrative circuit implementation of the circuit 20 in accordance with the invention shown in FIG. 2. Various other specific implementations will be apparent to those skilled in the art.

TABLE I

| Circuit Element | Circuit Type or Parametric Value |
|---|---|
| Preamplifier 24 | TTL Logic, Differential Input, Gain = 20 dB |
| Amplifier 26 | TTL Logic, Gain = 40 dB, 2@ Fairchild LM318 |
| Bandpass Filter 28 | Fairchild 3@ LM318, Variable Frequency from 50 KHz to 200 KHz |
| Peak Detectors 30, 32 | Fairchild LM311M |
| Resistor R1 | 3.9 KΩ |
| Resistor R2 | 22 Ω |
| Potentiometer P1 | Bourns 0–1 KΩ |
| Resistor R3 | 1 KΩ |
| Resistor R4 | 200 Ω |
| Potentiometer P2 | Bourns 0–10 KΩ |
| Voltage Comparators 38, 40 | Motorola MC14538B |
| Capacitors C1, C2 | .22 μf |
| Potentiometers P3, P4, P5 | Bourns 0–100 KΩ |
| Resistor R5 | 47 KΩ |
| EXCLUSIVE-OR Gate 42 | RCA CD4030 |
| Inverter 46 | RCA CD4001 |
| Fixed Duration Circuit 48 | Motorola MC14538B |
| Capacitor C3 | .33 μf |
| LED 50 | Sylvania ECG 3008 |
| Timer Circuit 54 | Sylvania NE555 |
| Delay Circuit 52 | RCA CD4031AF |
| Driver Circuit 58 | Isolated TTL with Darlington switching output |

In operation, material, such as shell fragments and nut meats, is transported by the product feeding means 12 so that the material falls particle by particle due to gravity onto the target means 14. The transducer means 16 responds to the shell fragments and nut meats which impinge on the target means 14 by producing a signal dependent on the mechanical vibrations imparted to the target means upon impact of the shell fragments and nut meats. The transduced signal is fed to the preamplifier 24 and thence to the amplifier 26 for producing a signal level sufficient for operation of the remainder of the circuit 20.

Figure 4A:
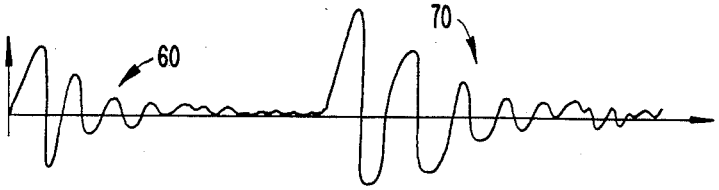
FIGS. 4A through 4G, is a timing diagram for the circuit shown in FIG. 2.

A conditioned signal 60 shown in FIG. 4A, for example, can be produced by the amplifier 26 at the node A shown in FIG. 2 upon initial impact of a particle against the target means 14. The signal produced by the amplifier 26 appears at the input of the bandpass filter 28. The center frequency of the bandpass filter 28 is preferably adjusted to a characteristic frequency of the transduced signal typically produced when a shell fragment impinges on the target means 14. As mentioned above, this characteristic frequency is preferably the second harmonic, i.e., approximately 110K hertz, with a pass band from 107.5K hertz to 112.5K hertz.

On the one hand, if the particle which has impacted against the target means 14 does not cause the amplifier 26 to produce a signal characteristic of the signal typically produced by shell fragments upon impact with the target means, no signal appears at the output of the bandpass filter 28. On the other hand, if the signal produced by the amplifier 26 includes frequency components in the range from 107.5K hertz to 112.5K hertz typically representative of the impact of a shell fragment against the target means 14, the bandpass filter 28 produces a bandpass filtered signal 62 shown in FIG. 4B at the node B shown in FIG. 2.

The output of the bandpass filter 28 is connected to the input of the differential or window comparator circuit 43 at the respective non-inverting inputs of the first peak detector (low) 30 and second peak detector (high) 32. The threshold of the peak detector (low) 30 is relatively low compared to the threshold of the peak detector (high) 32. If the signal produced by the bandpass filter 28 is of such a low amplitude as not to be distinguishable from background noise, transduced vibrations from operation of the product feeding means 12 to the target means 14, etc., the peak detector (low) 30 does not produce a signal. If, however, the signal produced by the bandpass filter 28 has a sufficient amplitude, the threshold of the peak detector (low) 30 is equaled or exceeded, and a signal 64 shown in FIG. 4C is produced by the peak detector (low) at the node C shown in FIG. 2, thereby generally indicating impact of a shell fragment against the target means 14. Consequently, the signal which appears at the output of the peak detector (low) 30 triggers the first voltage comparator 38 which produces a signal 66 shown in FIG. 4D having a high logic state at the node D shown in FIG. 2. The signal produced by the voltage comparator 38 appears at one input of the EXCLUSIVE-OR gate 42.

Figure 4B:
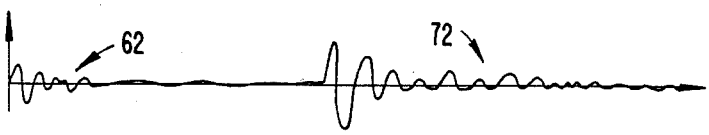
Figure 4C:
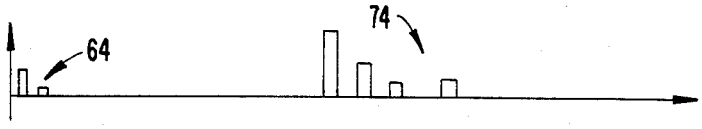
Figure 4D:
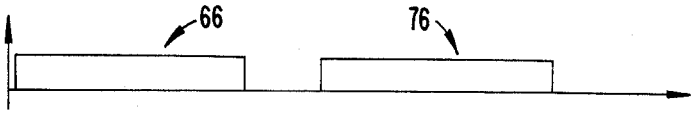
Figure 4E:
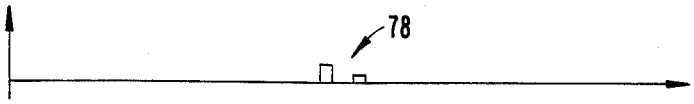
Figure 4F:
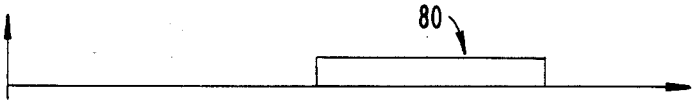
Figure 4G:
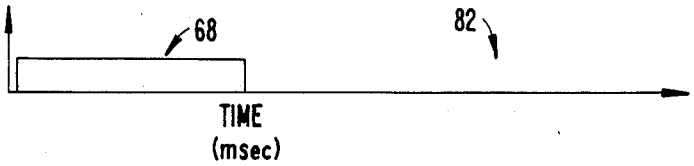

In the case of the signal 60 shown in FIG. 4A, the signal 62 shown in FIG. 4B produced by the bandpass filter 28 does not equal or exceed the threshold of the second peak detector (high) 32. Consequently, the peak detector (high) 32 does not produce a signal which triggers the second voltage comparator 40, as indicated in FIGS. 4E and 4F, respectively. Consequently, a signal having a low logic state appears at the other input of the EXCLUSIVE-OR gate 42. Since a signal having a high logic state appears at one input of the EXCLUSIVE-OR gate 42 and a signal having a low logic state appears at the other input of the gate, the signal 68 produced by the EXCLUSIVE-OR gate at the node G shown in FIG. 2 has a high logic state, as shown in FIG. 4G, which causes the reject control circuit 44 to energize the solenoid controlled air valve 56 for rejecting the particle as being a shell fragment.

Impact of additional material, for example, against the target means 14 can subsequently occur and cause the transducer means 16 to produce a signal which is fed to the preamplifier 24 and thence to the amplifier 26. A signal 70 shown in FIG. 4A is produced by the amplifier 26 at the node A shown in FIG. 2. The frequency of the signal which appears at the output of the amplifier 26 is shown to include frequency components in the range of 107.5K hertz to 112.5K hertz having significant amplitude, since a bandpass filtered signal 72 shown in FIG. 4B is produced by the bandpass filter 28 at the node B shown in FIG. 2. The signal produced by the bandpass filter 28 is indicated to have an amplitude which equals or exceeds the threshold of the first peak detector (low) 30, such that the peak detector (low) produces a signal 74 shown in FIG. 4C at the node C shown in FIG. 2. Consequently, the first voltage comparator 38 produces a signal 76 shown in FIG. 4D having a high logic state at the node D shown in FIG. 2, which appears at one input of the EXCLUSIVE-OR gate 42.

Unlike the case of the initial signal 60 shown in FIG. 4A produced by impact of a particle against the target means 14, the subsequent impact of a particle on the target means produces a signal having sufficient amplitude that the signal produced by the bandpass filter 28 equals or exceeds the threshold of the second peak detector (high) 32. Consequently, the peak detector (high) 32 produces a signal 78 shown in FIG. 4E at the node E shown in FIG. 2. The signal produced by the peak detector (high) 32 for the subsequent impact of a particle against the target means 14 therefore indicates that the particle which has impinged on the target means has a relatively substantial mass compared to the particle which initially impacted against the target means. As a consequence of the substantial mass of the particle which has impacted against the target means 14, the signal 70 shown in FIG. 4A, while having a frequency which is typically characteristic of a shell fragment, nevertheless has an amplitude attributable to a mass which is uncharacteristic of a shell fragment and which has a high probability of being a nut meat that for some reason, such as dryness developed during processing, produces frequency components in the range 107.5K hertz to 112.5K hertz. Consequently, the material is considered a nut meat rather than a shell fragment for purposes of operation of the reject control circuit 44.

The signal 78 shown in FIG. 4E produced by the peak detector (high) 32 triggers the second voltage comparator 40. Consequently, the second voltage comparator 40 produces a signal 80 shown in FIG. 4F having a high logic state at the node F shown in FIG. 2, which appears at the second input of the EXCLUSIVE-OR gate 42. As a result, signals having a high logic state appear at both inputs of the EXCLUSIVE-OR gate 42. Consequently, the EXCLUSIVE-OR gate 42 produces a signal 82 shown in FIG. 4G having a low logic state at the node G shown in FIG. 2, which disables the reject control circuit 44.

The operation of the circuit 20 in accordance with the invention provides high selectivity in the rejection of shell fragments from a mixture of shell fragments and nut meats. The circuit 20 in accordance with the invention also substantially reduces the likelihood of rejecting nut meats which for one reason or another cause the transducer means to produce a signal having a frequency characteristic like that of a shell fragment. The circuit 20 in accordance with the invention detects when a particle has a mass not expected for a shell fragment and cancels rejection of the particle. This reduces economic loss attendant to rejection of nut meats which for some reason have taken on the impact frequency characteristics of shell fragments.

The foregoing description is offered primarily for purpose of illustration. It will be readily apparent to those skilled in the art that numerous modifications and variations not mentioned above can be made. The target means 14 and the associated transducer means 16 can have any of a variety of implementations so long as a detectable signal is produced by the transducer means. The fundamental frequencies of signals produced by the transducer means 16 in response to impact of particles of different material against the target means 14 can vary in accordance with the implementation. Furthermore, an EXCLUSIVE-NOR gate can be substituted for the EXCLUSIVE-OR gate 42 and inverter 46. Also, the center frequency of the bandpass filter 28 can be selected based on the fundamental frequency or a harmonic of the signal produced by the impact against the target means 14 of nut meats, as opposed to shell fragments. These and other modifications can be made without departing from the spirit and scope of the invention as claimed below.

What is claimed is:

1. A sorting apparatus, comprising, in combination:

target means against which first particles and second particles are impinged;

transducer means for converting vibrations induced in the target means into an electrical signal having a frequency and amplitude representative of the vibrations caused by impact of the first particles and second particles against the target means; and a bandpass filter for filtering the signal produced by the transducer means for discriminating signals generally representative of first particles from those signals generally representative of second particles, the bandpass filter having a pass band with a center frequency which is a harmonic of the fundamental signal frequency generally representative of first particles.

2. The sorting apparatus of claim 1, further comprising a differential comparator circuit for discriminating of first particles for producing a reject signal.

3. The sorting apparatus of claim 2 wherein the target means is mechanically connected to the transducer means by a mechanical link and the bandpass filter is electrically connected to the differential comparator circuit, the sorting apparatus further comprising a signal conditioning circuit electrically connected between the transducer means and the bandpass filter for amplifying the signal produced by the transducer means.

4. The sorting apparatus of claim 3 wherein the differential comparator circuit comprises:

a first peak detector electrically connected to the bandpass filter;

a second peak detector electrically connected to the bandpass filter;

a first voltage comparator electrically connected to the first peak detector;

a second voltage comparator electrically connected to the second peak detector; and an EXCLUSIVE-OR gate having a first input electrically connected to the first voltage comparator and having a second input electrically connected to the second voltage comparator.

5. The sorting apparatus of claim 3, further comprising:

a reject control circuit electrically connected to the differential comparator circuit; and a solenoid controlled air valve electrically connected to the reject control circuit;

the reject control circuit being responsive to the reject signal for energizing the solenoid controlled air valve.

6. The sorting apparatus of claim 2 wherein the differential comparator circuit comprises:

a first peak detector electrically connected to the bandpass filter;

a second peak detector electrically connected to the bandpass filter;

a first voltage comparator electrically connected to the first peak detector;

a second voltage comparator electrically connected to the second peak detector; and an EXCLUSIVE-OR gate having a first input electrically connected to the first voltage comparator and having a second input electrically connected to the second voltage comparator.

7. The sorting apparatus of claim 2, further comprising:

a reject control circuit electrically connected to the differential comparator circuit; and a solenoid controlled air valve electrically connected to the reject control circuit;

the reject control circuit being responsive to the reject signal for energizing the solenoid controlled air valve.

8. The sorting apparatus of claim 2 wherein the first particles are shell fragments and the second particles are nut meats.

9. The sorting apparatus of claim 1 wherein the target means is mechanically connected to the transducer means by a mechanical link, the sorting apparatus further comprising a signal conditioning circuit electrically connected between the transducer means and the bandpass filter for amplifying the signal produced by the transducer means.

10. The sorting apparatus of claim 1 wherein the first particles are shell fragments and the second particles are nut meats.

11. A sorting apparatus, comprising, in combination:

target means against which first particles and second particles are impinged;

transducer means for converting vibrations induced in the target means into an electrical signal having a frequency and amplitude representative of the vibrations caused by impact of the first particles and second particles against the target means;

a filter having a pass band, the filter for filtering the signal produced by the transducer means for discriminating signals generally representative of first particles from those signals generally representative of second particles; and a differential comparator circuit comprising a plurality of peak detectors which compare signals within the pass band to a plurality of threshold signals for detecting that the signals within the pass band are not less than a first amplitude and are less than a second amplitude, the differential comparator circuit for discriminating signals within the pass band generally representative of first particles for producing a reject signal.

12. The sorting apparatus of claim 11 wherein the filter is a bandpass filter having a center frequency.

13. The sorting apparatus of claim 12 wherein the center frequency of the bandpass filter is the fundamental frequency of the signals generally representative of first particles.

14. The sorting apparatus of claim 12 wherein the center frequency of the bandpass filter is a harmonic of the fundamental signal frequency generally representative of first particles.

15. The sorting apparatus of claim 11 wherein the first particles are shell fragments and the second particles are nut meats.

16. The sorting apparatus of claim 12 wherein the first particles are shell fragments and the second particles are nut meats.

17. A method for sorting, comprising the steps of:

impinging first particles and second particles against target means;

converting vibrations induced in the target means into an electrical signal having a frequency and amplitude representative of the vibrations caused by impact of the first particles and second particles against the target means; and bandpass filtering the signal for discriminating signals generally representative of first particles from those signals generally representative of second particles by the use of a bandpass filter having a pass band with a center frequency which is a harmonic of the fundamental frequency generally representative of first particles.

18. The method of claim 17, further comprising the steps of:

discriminating signals within the pass band generally representative of first particles by the use of a differential comparator circuit; and producing reject signals when first particles impinge against the target means.

19. The method of claim 18 wherein the first particles are shell fragments and the second particles are nut meats.

20. The method of claim 17 wherein the first particles are shell fragments and the second particles are nut meats.

21. A method for sorting, comprising the steps of:

impinging first particles and second particles against target means;

converting vibrations induced in the target means into an electrical signal having a frequency and amplitude representative of the vibrations caused by impact of the first particles and second particles against the target means;

filtering the signal for discriminating signals generally representative of first particles from those signals generally representative of second particles by the use of a filter having a pass band;

discriminating signals within the pass band generally representative of first particles by the use of a differential comparator circuit comprising a plurality of peal detectors which compare signals within the pass band to a plurality of threshold signals for detecting that the signals within the pass band are not less than a first amplitude and are less than a second amplitude; and producing reject signals when first particles impinge against the target means.

22. The method of claim 21 wherein the filtering step comprises the steps of bandpass filtering by the use of a bandpass filter having a center frequency.

23. The method of claim 22 wherein the center frequency for bandpass filtering is the fundamental frequency of the signals generally representative of first particles.

24. The method of claim 22 wherein the center frequency for bandpass filtering is a harmonic of the fundamental signal frequency generally representative of first particles.

25. The method of claim 22 wherein the first particles are shell fragments and the second particles are nut meats.

26. The method of claim 21 wherein the first particles are shell fragments and the second particles are nut meats.

27. A sorting apparatus, comprising, in combination:

target means against which first particles and second particles are impinged;

transducer means for converting vibrations induced in the target means into an electrical signal having a frequency and amplitude representative of the vibrations caused by impact of the first particles and second particles against the target means;

means for filtering the signal for discriminating signals generally representative of first particles from those signals generally representative of second particles, the means for filtering having a pass band, the frequency of the signals generally representative of second particles occasionally being substantially similar to the frequency of signals generally representative of first particles;

means for discriminating signals within the pass band generally representative of first particles on the basis of amplitude by detecting that the signals within the pass band are not less than a first amplitude and are less than a second amplitude; and means for producing reject signals when first particles impinge against the target means;

whereby rejection of second particles, which produce a signal frequency generally representative of first particles but which produce a relatively greater signal amplitude than generally representative of first particles, is avoided so that mass weight problems are alleviated.

28. The sorting apparatus of claim 27 wherein the means for filtering comprises a bandpass filter having a center frequency.

29. The sorting apparatus of claim 28 wherein the center frequency of the bandpass filter is the fundamental frequency of the signals generally representative of first particles.

30. The sorting apparatus of claim 28 wherein the center frequency of the bandpass filter is a harmonic of the fundamental signal frequency generally representative of first particles.

31. The sorting apparatus of claim 27 wherein the first particles are shell fragments and the second particles are nut meats.

32. A method for sorting, comprising the steps of:

impinging first particles and second particles against target means;

converting vibrations induced in the target means into an electrical signal having a frequency and amplitude representativ of the vibrations caused by impact ofthe first particles and second particles against the target means;

filtering the signal for discriminating signals generally representative of first particles from those signals generally representative of second particles by the use of a filter having a pass band, the frequency of the signals generally representative of second particles occasionally being substantially similar to the frequency of the signals generally representative of first particles;

discriminating signals within the pass band generally representative of first particles on the basis of amplitude by detecting that the signals within the pass band are not less than a first amplitude and are less than a second amplitude; and producing reject signals when first particles impinge against the target means;

thereby avoiding rejection of second particles producing a signal frequency generally representative of first particles but producing a relatively greater signal amplitude than generally representative of first particles so that mass weight problems are alleviated.

33. The method of claim 32 wherein the filtering step comprises the step of bandpass filtering by the use of a bandpass filter having a pass band with a center frequency.

34. The method of claim 33 wherein the center frequency for bandpass filtering is the fundamental frequency of the signals generally representative of first particles.

35. The method of claim 33 wherein the center frequency for bandpass filtering is a harmonic of the fundamental signal frequency generally representative of first particles.

36. The method of claim 32 wherein the first particles are shell fragments and the second particles are nut meats.

37. A sorting apparatus, comprising, in combination:

target means against which first particles and second particles are impinged;

transducer means for converting vibrations induced in the target means into an electrical signal having a frequency and amplitude representative of the vibrations caused by impact of the first particles and second particles against the target means;

a bandpass filter having a pass band, the filter for filtering the signal produced by the transducer means for discriminating signals generally representative of first particles from those signals generally representative of second particles; and a differential comparator circuit electrically connected to the bandpass filter for discriminating signals within the pass band generally representative of first particles for producing a reject signal, comprising:

(a) a first peak detector electrically connected to the bandpass filter;

(b) a second peak detector electrically connected to the bandpass filter;

(c) a first voltage comparator electrically connected to the first peak detector;

(d) a second voltage comparator electrically connected to the second peak detector; and (e) an EXCLUSIVE-OR gate having a first input electrically connected to the first voltage comparator and having a second input electrically connected to the second voltage comparator.

38. The sorting apparatus of claim 37 wherein the target means is mechanically connected to the transducer means by a mechanical link, the sorting apparatus further comprising a signal conditioning circuit electrically connected between the transducer means and the bandpass filter for amplifying the signal produced by the transducer means.

* * * * *